US011597004B2

(12) United States Patent
Carboni

(10) Patent No.: US 11,597,004 B2
(45) Date of Patent: Mar. 7, 2023

(54) APPARATUS AND METHOD TO CONTROL CONTINUOUS CASTING, USING ELECTROMAGNETIC BRAKE

(71) Applicant: DANIELI & C. OFFICINE MECCANICHE S.P.A., Buttrio (IT)

(72) Inventor: Andrea Carboni, Milan (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 17/253,471

(22) PCT Filed: Jun. 28, 2019

(86) PCT No.: PCT/IT2019/050156
§ 371 (c)(1),
(2) Date: Dec. 17, 2020

(87) PCT Pub. No.: WO2020/003336
PCT Pub. Date: Jan. 2, 2020

(65) Prior Publication Data

US 2021/0268575 A1 Sep. 2, 2021

(30) Foreign Application Priority Data

Jun. 28, 2018 (IT) ..... 102018000006751

(51) Int. Cl.
*B22D 11/18* (2006.01)
*B22D 11/115* (2006.01)
*B22D 11/117* (2006.01)

(52) U.S. Cl.
CPC ..... *B22D 11/186* (2013.01); *B22D 11/115* (2013.01); *B22D 11/117* (2013.01)

(58) Field of Classification Search
CPC ..... B22D 11/115; B22D 11/117; B22D 11/18; B22D 11/186; B22D 11/11; B22D 11/181
USPC ..... 164/466, 467, 468, 502, 503, 504, 453, 164/151.2, 151.3, 154.5, 449.1, 450.3, 164/450.4
See application file for complete search history.

(56) References Cited

FOREIGN PATENT DOCUMENTS

| | | |
|---|---|---|
| EP | 1021262 B1 | 6/2004 |
| EP | 1567296 B1 | 4/2011 |
| JP | S63 104758 A | 5/1988 |

OTHER PUBLICATIONS

International Search Report and Written Opinion from PCT/IT2019/050156 dated Nov. 8, 2019 (12 pages).

*Primary Examiner* — Kevin P Kerns
(74) *Attorney, Agent, or Firm* — Calfee Halter & Griswold LLP

(57) ABSTRACT

Apparatus to control continuous casting, including a mold provided with at least one entrance end through which liquid metal is introduced. Furthermore, the apparatus to control continuous casting includes at least one electromagnetic brake associated with the mold, configured to induce in the liquid metal recirculation flows, and a control and command unit connected at least to the electromagnetic brake and configured to manage the functioning thereof.

13 Claims, 3 Drawing Sheets

APPARATUS AND METHOD TO CONTROL CONTINUOUS CASTING, USING ELECTROMAGNETIC BRAKE

CROSS-REFERENCE TO RELATED APPLICATIONS

This application is a 371 of PCT Application No. PCT/IT2019/050156 filed on Jun. 28, 2019, which claims priority to Italian Application No. 102018000006751 filed on Jun. 28, 2018, the contents of which are hereby incorporated by reference as if recited in their entirety.

FIELD OF THE INVENTION

The present invention concerns an apparatus to control continuous casting.

More particularly, the apparatus to control continuous casting allows to detect the surface profile of the liquid metal present in a mold and possibly control the functioning of operating units associated with the mold, such as for example the liquid metal discharger and/or electromagnetic brakes.

The present invention also concerns a corresponding method to control continuous casting.

BACKGROUND OF THE INVENTION

Continuous casting apparatuses are known which generally comprise a mold in which a liquid metal is introduced to be solidified thanks to the interaction of the latter with the cooled walls of the mold.

These continuous casting apparatuses therefore comprise a discharge device, or nozzle, positioned at the entrance end of the mold and which discharges, in the latter, the liquid metal coming from another container, for example a tundish. The nozzle can also be configured to deliver a process gas, for example an inert gas, such as argon, to isolate the liquid metal that is being discharged.

It is also known to distribute powders to cover and protect the liquid metal on the free surface of the liquid metal, also called meniscus.

These powders have the function of preventing the oxidation of the liquid metal and the dispersion of the heat of the liquid metal in the upper part of the mold. Furthermore, the powders are interposed between the walls of the mold and the metal skin that is solidifying, favoring lubrication, facilitating the extraction of the metal product and avoiding adhesion phenomena, also known as "sticking".

It is also known to associate electromagnetic devices with the mold, also known as electromagnetic brakes, provided to control the direction and speed of the recirculation flows present in the liquid metal. The recirculation flows, if controlled, prevent the occurrence of defects of the cast product, such as segregations, inclusions, or internal porosities.

The action of the electromagnetic brakes, however, has to be suitably controlled during the continuous casting at least according to the casting speed, the width of the mold, the depth of the position, that is, immersion, of the nozzle in the mold, the flow rate of the process gasses through the nozzle.

In fact, as a function of the actions that the electromagnetic brakes are able to generate it is possible to obtain different configurations of the flows of the liquid metal.

By way of example only, it is possible to obtain recirculation flows of the liquid metal with a single recirculation, also called "single roll", or double recirculation, also called "double roll".

The single recirculation type is usually unwanted and is normally generated by casting complications that entail problems of quality of the final product. The only recirculation that is generated extends essentially from the inside toward the outside of the mold causing an excessive turbulence of the liquid metal toward the meniscus, in proximity to the nozzle.

The double recirculation type, on the other hand, represents the optimal configuration of the flows inside the mold to obtain a high quality product.

In fact, the double recirculation type generates both a recirculation that extends toward the surface of the liquid metal, and also a recirculation that extends deep into the mold.

To obtain a double recirculation it is necessary to generate a balance between the upper recirculations and the lower recirculations.

In fact, if there are too many upper recirculations compared to lower recirculations, a high vorticity is generated on the surface of the meniscus which can lead to the onset of defects in the cast product such as:

- longitudinal cracks due to non-homogeneous solidifications,
- non-homogeneous distribution of the molten lubricant powders that produces cracks and sticking,
- turbulences that generate vortices and entrapment of powder with consequent generation of non-metal inclusions.

On the other hand, if there are too many lower recirculations compared to upper recirculations, there is a freezing of the meniscus in proximity to the walls of the mold.

Some known apparatuses and methods to monitor and regulate recirculations are for example described in patent documents EP1567296B1, EP1021262B1 and JPS63104758A.

It is a purpose of the present invention to develop an apparatus to control continuous casting which allows to resolve the problems highlighted above, in a more efficient and accurate manner than known apparatuses and methods.

It is also a purpose of the present invention to provide an apparatus to control continuous casting which allows to increase the quality of cast products.

It is also a purpose of the present invention to provide an apparatus to control continuous casting which is simple to make and install, and economical.

It is also a purpose of the invention to perfect a method to control continuous casting which allows to increase the quality of the cast products.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an apparatus to control continuous casting, according to the present invention, comprises:

- a mold provided with at least one entrance end through which the liquid metal is introduced,
- at least one electromagnetic brake associated with the mold and configured to induce in the liquid metal recirculation flows, and a control and command unit connected at least to the electromagnetic brake and configured to manage the functioning of the latter.

According to possible solutions, the control apparatus comprises detection means located, at least in a condition of use, above the entrance end of the mold and each configured to detect at least a reciprocal distance with respect to the level of the liquid metal. The control and command unit is also connected to the detection means to acquire the data of each distance from each detection mean, process them in relation to the positioning of the detection means, determining characteristic parameters of the development of the surface profile of the liquid metal, and to command the drive at least of the electromagnetic brake based on the characteristic parameters of the development of the surface profile.

This configuration, in relation to the development of the surface profile of the liquid metal, allows to assess whether the recirculation flows that are established in the mold are particularly effective for obtaining a cast product of high quality.

The expression "detection of the surface profile", here and in the following description and claims, is intended to comprise the detection of the shape of the profile of the liquid metal as such and/or the detection of layers normally present above the level of the liquid metal present in the mold, such as layers of protective powders located to protect the liquid metal.

The present invention also concerns a method to control continuous casting which provides to cast a liquid metal by introducing the latter through an entrance end of a mold. During casting, a control and command unit manages the functioning of an electromagnetic brake associated with the mold, to induce recirculation flows in the liquid metal.

According to one possible implementation of the invention, the method comprises the detection of data of at least a reciprocal distance with respect to the level of the liquid metal by means of detection means located, at least in a condition of use, above the entrance end, the processing of the data of at least a distance in relation to the positioning of the detection means, determining characteristic parameters of the development of the surface profile, and the driving at least of the electromagnetic brake based on the characteristic parameters of the development of the surface profile in order to determine predefined recirculation flows of the liquid metal.

In some embodiments, the characteristic parameters can comprise the evolution speed of the surface profile and/or the temporal average of the distance calculated on predetermined time intervals and/or the instant deviations from the temporal average for each detection mean.

In some embodiments, the characteristic parameters can comprise the spatial gradient of the surface profile and/or the spatial average of the distances detected in different positions and/or the instant deviations from the spatial average for each detection mean.

These characteristics allow to monitor the development of the surface profile not only on the basis of information localized in space and defined in time, but also evaluating the overall development of the entire shape of the surface profile over time, as a function of the whole cross-section of the mold, providing a more accurate monitoring compared to known apparatuses.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
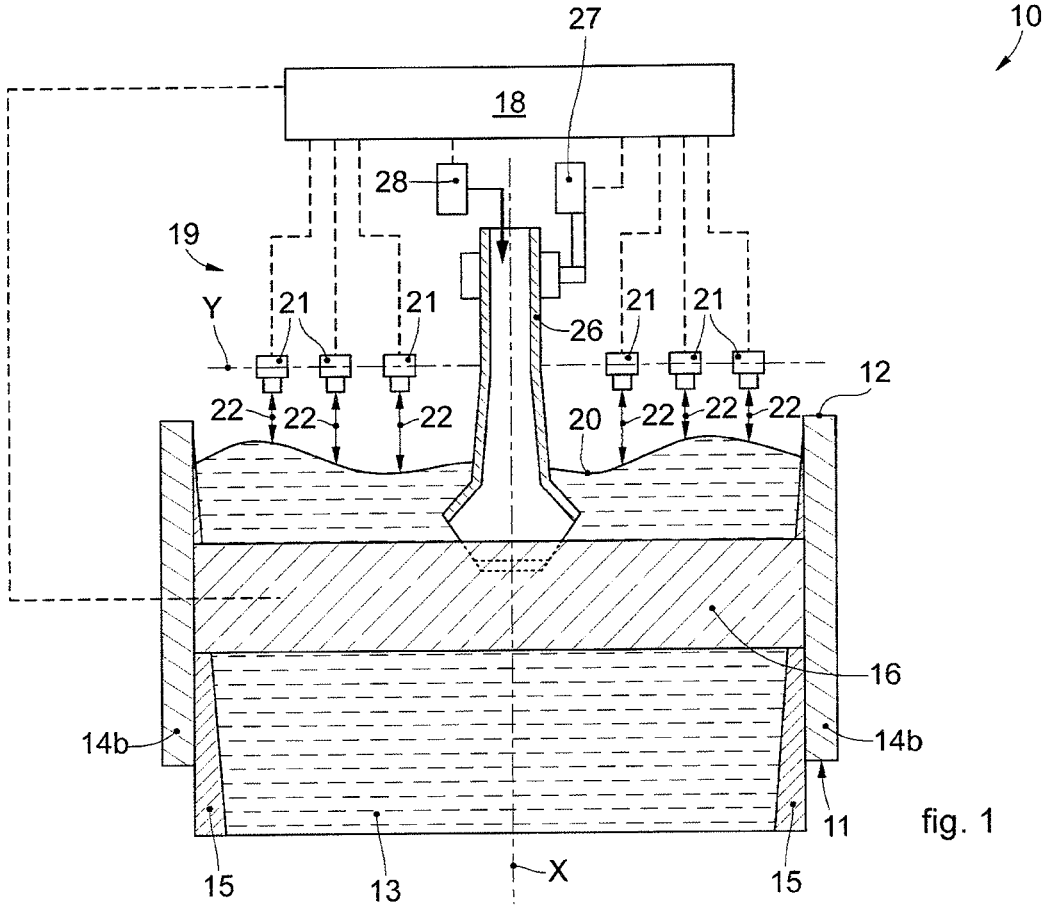
FIG. 1 is a schematic drawing of an apparatus to control continuous casting according to the present invention.

With reference to the attached drawings, an apparatus 10 to control continuous casting, according to the present invention, is indicated as a whole with the reference number 10.

The control apparatus 10, according to the present invention, comprises a mold 11 provided with an entrance end 12 through which the liquid metal 13 is introduced to be subsequently solidified.

Preferential, although non-limiting, embodiments of the present invention provide that the mold 11 is configured to cast slabs.

In particular, the invention can be applied to all types of continuously castable slabs, for example having thicknesses comprised between 22 mm and 500 mm and widths between 500 mm and 4500 mm.

The mold 11 is provided with walls 14 suitably cooled by means of cooling devices, not shown.

In particular, if the mold 11 is of the type for slabs, the walls 14 are defined by substantially flat plates located in opposite pairs and wherein a first pair 14*a* of plates has much bigger surface sizes than the surface sizes of a second pair 14*b* of plates.

The solidification of the liquid metal 13 occurs in the mold 11 with the consequent formation of a solidified containing skin 15.

The mold 11 extends along a substantially vertical or arched casting axis X.

Figure 5:
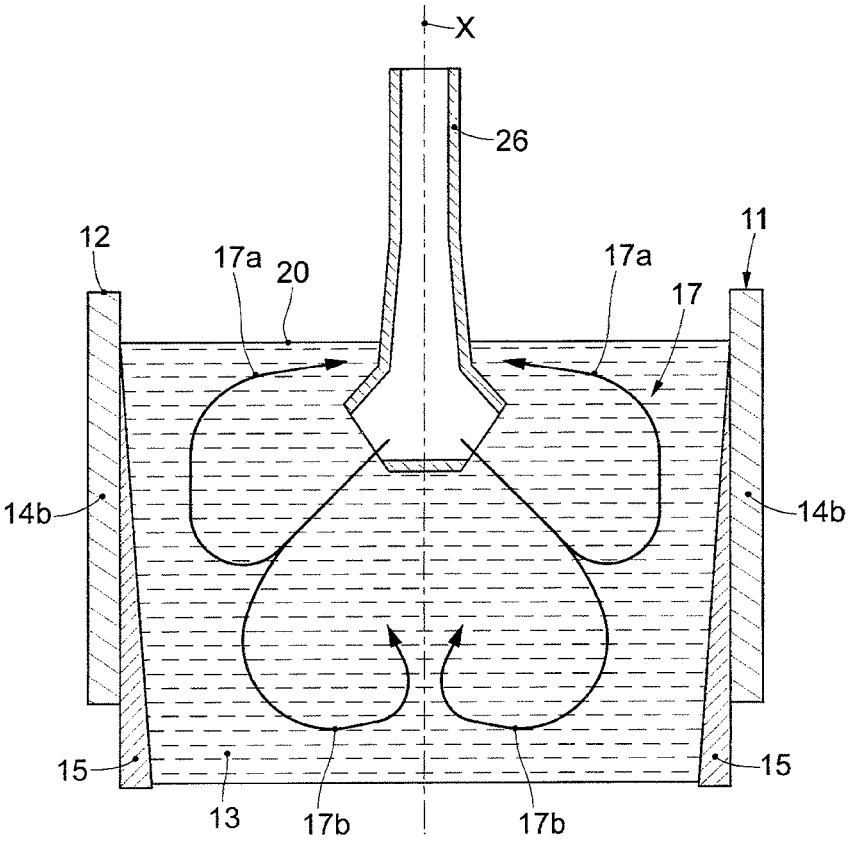
FIG. 5 schematically shows the fluid-dynamic motions in a mold.

According to one aspect of the invention, the control apparatus 10 comprises at least one electromagnetic brake 16 associated with the mold 11 and configured to induce recirculation flows 17 in the liquid metal 13 (FIG. 5).

The electromagnetic brake 16 can be attached to the mold 11, for example on the external surface of its walls 14.

Figure 2:
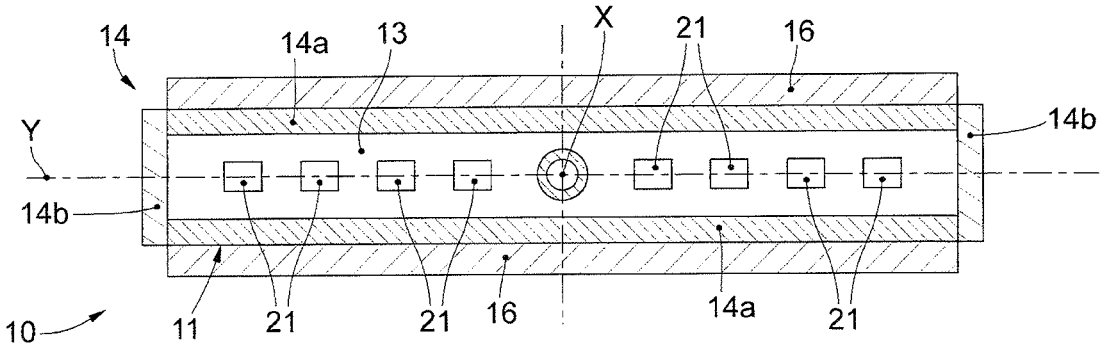
FIG. 2 is a view from above of FIG. 1.
Figure 3:
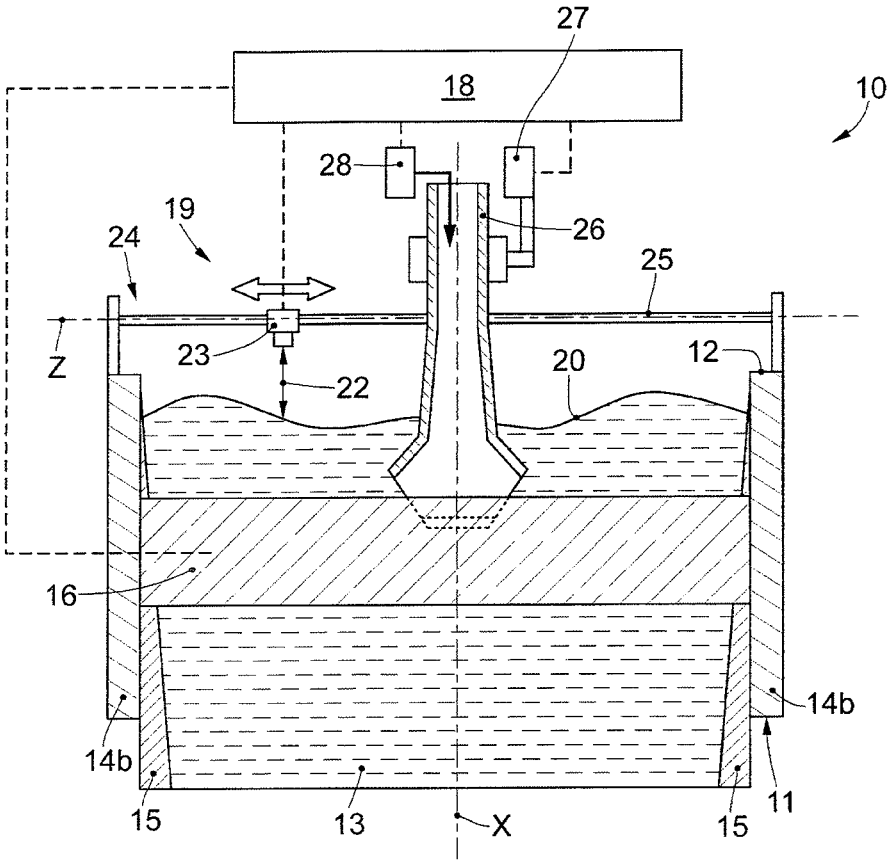
FIG. 3 shows a variant of FIG. 1.

According to a possible solution (FIGS. 1-3), the control apparatus 10 comprises a plurality of electromagnetic brakes 16 which are associated on the surfaces which, during use, are external of the first pair 14*a* of walls of the mold 11.

According to possible embodiments, the control apparatus 10 can comprise a plurality of electromagnetic brakes 16, for example at least one per wall 14 of the mold 11.

According to a possible solution, the plates of the first pair 14*a* can each comprise a respective electromagnetic brake 16 which extends for the entire width of the plate.

According to variant embodiments, the plates of the first pair 14*a* can each comprise a plurality of electromagnetic brakes 16 located adjacent and in a symmetrical position with respect to the center line of the mold 11.

Figure 4:
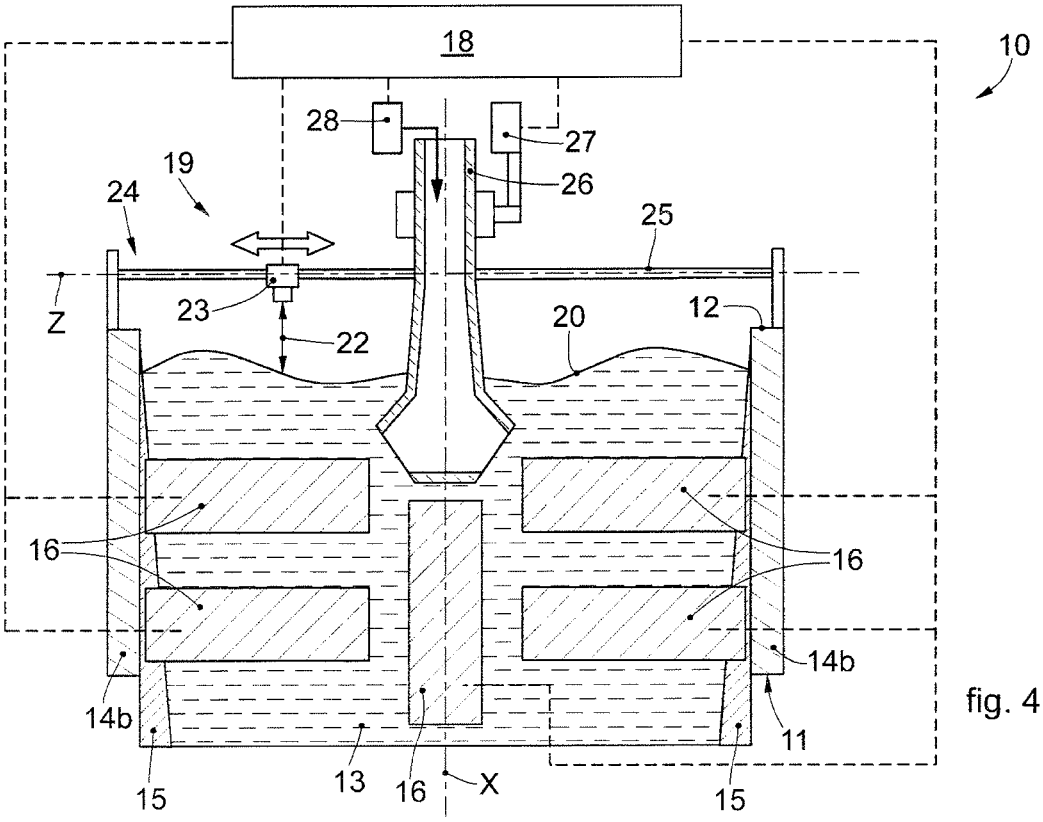
FIG. 4 shows a further variant of FIG. 1.

In particular (FIG. 4), it can be provided that for each plate of the first pair 14*a* there is at least one first electromagnetic brake 16, in this case two, distanced along the casting axis, located on one side with respect to the median axis of the mold 11, and at least one second electromagnetic brake 16, in this case two, distanced along the casting axis X, located on a second side, opposite the first with respect to the median axis of the mold 11. Furthermore, in a central position, that is, aligned with the median axis, for each plate of the first pair 14*a* another electromagnetic brake 16 can be provided interposed between the first and the second electromagnetic brake 16.

The electromagnetic brake 16 can comprise a plurality of coils, possibly cooled, and suitably electrically powered to generate predetermined recirculation flows 17 in the mold 11.

According to a further aspect of the present invention, the control apparatus 10 comprises a control and command unit 18 connected to the at least one electromagnetic brake 16 and configured to manage its functioning.

By way of example only, the control and command unit 18 can be configured to control at least one electric parameter of the electric energy supplied to the electromagnetic brakes 16, such as the voltage and/or the electric current. By way of example only, it can be provided that the control and command unit 18 is configured to control at least one of either the intensity or frequency of the electric parameter above.

According to further embodiments of the invention, the control apparatus 10 comprises detection means 19 located, at least in a condition of use, above the entrance end 12 of the mold 11 and each configured to detect at least a reciprocal distance 22 with respect to the level of the liquid metal 13.

The control and command unit 18 can be configured to acquire the data of each distance 22 from each detection mean 19 and process them in relation to the positioning of the detection means 19, determining characteristic parameters of the development of the surface profile 20 of the liquid metal 13.

Advantageously, the processing of the distance 22 in relation to the positioning of the detection means 19 allows to determine the shape of the whole surface profile 20 of the liquid metal 13 along the whole cross-section of the mold 11, and not only on localized and circumscribed portions as in some known solutions.

Furthermore, the control and command unit 18 can process the data of each distance 22 determining, as characteristic parameters, the spatial average of the distances 22 detected in different positions, and the instant deviations therefrom for each detection mean 19.

In some embodiments, other possible characteristic parameters can be the spatial gradient or also higher order derivatives of the surface profile 20, which allow to monitor the extent of the spatial variations in the development of the surface profile 20.

The detection means 19 can be configured to detect the reciprocal distance 22 at predetermined time instants, for example in relation to specific operating steps of the casting process. According to variant embodiments, the detection means 19 can be configured to substantially detect the reciprocal distance 22 continuously.

In these embodiments, the control and command unit 18 can process the data of each distance 22 determining, as characteristic parameters, the temporal average of the distance 22 on predetermined time intervals, and the instant deviations from it for each detection mean 19.

In some embodiments, other possible characteristic parameters can be the evolution speed of the development of the surface profile 20, calculated starting from the time derivatives.

The characteristic parameters associated with instant, temporal and spatial averages and deviations, allow to obtain an accurate determination of the development of the surface profile, since, for example, there is a reduction in the background noise effects linked to the type of sensors used and random errors in the detections due to the formation of bubbles or splashes of liquid metal 13. Furthermore, it is possible to immediately identify possible malfunctions in one or more detection means 19, for example if it/they sends/send data that are significantly and systematically far from the averages.

The control and command unit 18 can also determine the action at least on the at least one electromagnetic brake 16 on the basis of the characteristic parameters of the development of the surface profile 20, in order to determine predefined recirculation flows 17 of the liquid metal 13.

The control and command unit 18 can be configured to manage the functioning of the components above and command the drive of at least the electromagnetic brake 16, so as to maintain the development of the surface profile 20 uniform.

Advantageously, the characteristic parameters associated with the spatial gradient and the evolution speed of the surface profile 20 allow to drive the electromagnetic brake 16, respectively, with suitable drive speed and intensity to efficiently regulate the recirculation flows 17.

This characteristic therefore allows to obtain recirculation flows that are constant and regular in space and time, improving the quality of the cast product.

According to one possible embodiment of the invention, the detection means 19 can comprise a plurality of sensors 21 located above the surface of the liquid metal 13.

According to possible solutions, each sensor 21 is configured to detect a reciprocal distance 22 with respect to the level of the liquid metal 13.

In particular, each sensor 21 is connected to the control and command unit 18 which is configured to acquire the data of each distance 22, process them in relation to the positioning of the sensors 21, and determine the surface profile 20.

In particular, the control and command unit 18 can store at least the reciprocal position of each sensor 21 with respect to the other sensors, as well as with respect to the upper end 12 of the mold 11.

The presence of a plurality of sensors 21 distributed above the level of the liquid metal allows to use sensors with a reduced detection field, that is, sensors of small sizes and not very invasive for the upper end 12 of the mold 11.

According to possible solutions, the sensors 21 can comprise induced current sensors, that is, Eddy Current sensors. The use of this type of sensor allows to have rapid response times. Furthermore, this type of sensor allows to also reuse the latter on other molds and for different applications.

According to possible variant embodiments, the sensors 21 can be selected from a group comprising thermal, optical, laser, radar or capacitive sensors.

According to a possible solution of the invention, the sensors 21 can be disposed aligned along an axis Y orthogonal to the casting axis X.

In the embodiment in which the mold 11 is of the type for slabs, the Y axis is positioned substantially parallel to the pair of walls with bigger sizes.

For example, the plurality of sensors 21 can be distributed in a symmetrical manner, on one side and on the other, with respect to the casting axis X, as well as in scattered order.

Furthermore, the sensors 21 can be equally distanced from each other to be able to detect the surface profile 20 in a uniform manner.

Variations of the embodiments, provide that the plurality of sensors 21 is distributed only on one side, that is, only on a part of the surface of the liquid metal 13 with respect to the casting axis X.

In these cases, it is assumed that the development of the surface profile 20 is symmetrical with respect to the casting axis X. These embodiments can be used on molds 11 with small sizes, where the surface profile 20 is almost symmetrical along the casting axis X.

In variants of the present invention, the detection means 19 can comprise a detector 23, which can be for example a sensor of the type indicated above, configured to detect a distance 22 with respect to the liquid metal 13, and a movement device 24 configured to move the detector 23 above the level of liquid metal 13, that is, above the upper end 12.

According to one possible solution, the movement device 24 is configured to move the detector 23 along a longitudinal axis Z orthogonal to the casting axis X.

In the embodiment in which the mold 11 is of the type for slabs, the longitudinal axis Z is positioned substantially parallel to the pair of walls with bigger sizes.

The movement device 24 can be provided with at least a guide element 25 on which the detector 23 is installed slidable along the longitudinal axis Z.

The guide element 25 can be associated with the entrance end 12 of the mold 11.

The guide element 25 can extend for the entire width of the mold 11.

The detector 23 is connected to the control and command unit 18 which is configured to receive the distance data 22 detected instantly by the detector 23 during its movement, in this way performing a scanning of the surface of the liquid metal. The control and command unit 18, by processing this distance data 22, determines the characteristic parameters of the development of the surface profile 20.

In some embodiments of the present invention, the control apparatus 10 according to the present invention comprises a nozzle 26 configured to discharge the liquid metal 13 into the mold.

The nozzle 26 is connected to the control and command unit 18 which is configured to manage the functioning of the nozzle 26, in relation to the characteristic parameters of the development of the surface profile 20 detected.

The nozzle 26 is positioned, through the upper end 12, in the mold 11, and is partly immersed in the liquid metal 13.

According to possible solutions, the nozzle 26 can be associated with displacement devices 27 (FIG. 1) configured to move the nozzle 26 in a direction parallel to the casting axis X and modify the positioning of the exit end of the nozzle 26 in the mold 11.

According to possible solutions, delivery devices 28 can also be associated with the nozzle 26, which are configured to deliver in the nozzle 26 auxiliary stirring gases of the liquid metal 13 in the mold 11.

Auxiliary gases can comprise inert gases, such as argon.

According to possible solutions, at least one, or both, of either the displacement devices 27 or the delivery devices 28 can be connected to the control and command unit 18 which is configured to determine a movement of the displacement devices 27 and/or the drive of the delivery devices 28 in relation to the characteristic parameters of the development of the surface profile 20 detected and to determine a control of the fluid-dynamic flows of the liquid metal 13 in the mold 11.

According to some embodiments of the invention, the control and command unit 18 is configured to manage the functioning at least of the electromagnetic brake 16, and possibly of the displacement devices 27 and the delivery devices 28, so as to obtain desired recirculation flows 17 such as to allow to obtain a high quality cast product.

Specifically, it is provided that the control and command unit 18, as a function of the development of the surface profile 20 detected, allows to generate double recirculation flows of the liquid metal 13, as shown in FIG. 5.

In particular, this flow configuration allows to generate a first recirculation 17*a* which develops from the discharge end of the nozzle 26 toward the surface of the liquid metal 13, and a second recirculation 17*b* which develops from the discharge end of the nozzle 26 toward the inside of the mold 11.

The first recirculation 17*a* allows to avoid a stagnation of the liquid metal 13 in the upper part of the mold, which determines the so-called freezing of the meniscus, that is, an unwanted cooling of the portion of liquid metal 13 present on the surface.

By means of the detection of the surface profile 20 with the detection means 19, it is possible to determine the modes, that is, the development, of the recirculation flows 17 that are established inside the mold 11. The surface profile 20, that is, the shape of the meniscus, is closely connected to the speed of the flow of the liquid metal 13 in the first recirculation 17*a*. The amplitude of the waves and their positioning, that is, the type of development of the surface profile 20, allow to reliably determine the energy, the speed, and therefore the flow rate of the first recirculation 17*a*.

Based on the flow rate of the first recirculation 17*a*, the control unit 18 is able to act on the functioning of the electromagnetic brakes 16, in order to optimize the motion of the recirculation flows 17 contained in the liquid metal 13.

In particular, it is possible to obtain the correct flow distribution between the first recirculation 17*a* and the second recirculation 17*b* in any operating casting condition.

It is clear that modifications and/or additions of parts may be made to the apparatus 10 as described heretofore, without departing from the field and scope of the present invention.

For example, in one possible solution, the detection means 19 can be able to detect, in addition to the development of the surface profile, also the level of the meniscus of the mold 11.

It is also clear that, although the present invention has been described with reference to some specific examples, a person of skill in the art shall certainly be able to achieve many other equivalent forms of control apparatus 10, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Apparatus to control continuous casting, said apparatus comprising a mold provided with at least one entrance end through which liquid metal is introduced, at least one electromagnetic brake associated with the mold and configured to induce in said liquid metal recirculation flows, and a control and command unit connected at least to said electromagnetic brake and configured to manage functioning thereof, wherein the apparatus comprises detection means located, at least in a condition of use, above the at least one entrance end and each configured to detect at least a reciprocal distance with respect to a level of said liquid metal, wherein said control and command unit is also connected to said detection means to acquire data of each distance from each detection mean, wherein said control and command unit is configured to process the data of each distance from each detection mean in relation to positioning of said detection means, determine characteristic parameters of a development of a surface profile of said liquid metal based upon each distance, and command a drive at least of said electromagnetic brake based on said characteristic parameters of the development of said surface profile in order to determine predefined recirculation flows of the liquid metal, and wherein the characteristic parameters of the development of said surface profile of said liquid metal comprise an evolution speed of the surface profile and instant deviations from a temporal average for each detection mean.

2. Apparatus to control continuous casting as in claim 1, wherein the characteristic parameters of the development of the surface profile of said liquid metal further comprise a spatial gradient of the surface profile, a spatial average of the distances detected in different positions, and instant deviations from a spatial average for each detection mean.

3. Apparatus to control continuous casting as in claim 1, wherein said control and command unit is configured to command the drive at least of said electromagnetic brake so as to maintain said development of the surface profile uniform.

4. Apparatus to control continuous casting as in claim 1, wherein said detection means comprise a plurality of sensors located above a surface of the liquid metal, wherein each sensor is configured to detect a reciprocal distance with respect to the level of the liquid metal.

5. Apparatus to control continuous casting as in claim 4, wherein said sensors comprise induced current sensors and/or a group of sensors selected from thermal, optical, laser, radar or capacitive sensors.

6. Apparatus to control continuous casting as in claim 1, wherein said mold has a slab shape, and comprises walls defined by substantially flat plates located in opposite pairs and wherein a first pair of plates has bigger surface sizes than surface sizes of a second pair of plates, wherein the sensors are disposed aligned along an axis orthogonal to a casting axis, and wherein said axis is positioned substantially parallel to the first pair of plates.

7. Apparatus to control continuous casting as in claim 1, wherein said detection means comprise a detector configured to detect a distance with respect to the liquid metal, and a movement device configured to move the detector above the level of liquid metal.

8. Apparatus to control continuous casting as in claim 7, wherein said mold has a slab shape, and comprises walls defined by substantially flat plates located in opposite pairs and wherein a first pair of plates have a first surface size and a second pair of plates have a second surface size, wherein the first surface size is larger than the second surface size, wherein the movement device is configured to move the detector along a longitudinal axis orthogonal to a casting axis, wherein said longitudinal axis is positioned substantially parallel to a first pair of walls.

9. Apparatus to control continuous casting as in claim 7, wherein said detector is configured as a sensor selected in a group from induced current, thermal, optical, laser, radar or capacitive sensors.

10. Apparatus to control continuous casting as in claim 1, wherein the apparatus comprises a nozzle configured to discharge the liquid metal into the mold, wherein said nozzle is connected to the control and command unit which is configured to manage functioning of the nozzle, in relation to said characteristic parameters of the development of the surface profile detected.

11. Apparatus to control continuous casting as in claim 10, wherein displacement devices are associated with the nozzle in order to move the nozzle in a direction parallel to a casting axis and to modify positioning of its exit end in the mold, and wherein said displacement devices are connected to the control and command unit which is configured to determine a movement of the displacement devices in relation to said characteristic parameters of the development of the surface profile detected.

12. Apparatus as in claim 10, wherein delivery devices are associated with the nozzle, configured to deliver auxiliary stirring gases of the liquid metal into the nozzle, and wherein at least the delivery devices are connected to the control and command unit which is configured to determine a drive of the delivery devices in relation to said characteristic parameters of the development of the surface profile detected.

13. A method to control continuous casting of a liquid metal, comprising:

introducing the liquid metal through an entrance end of a mold, managing, by a control and command unit, functioning of an electromagnetic brake associated with the mold, to induce in liquid metal recirculation flows, detecting data of at least a reciprocal distance with respect to a level of the liquid metal by means of detection means located, at least in a condition of use, above the entrance end, processing said data of at least a distance in relation to position of said detection means, determining characteristic parameters of a development of a surface profile, wherein the characteristic parameters comprise an evolution speed of the surface profile and instant deviations from a temporal average for each detection mean, driving at least of said electromagnetic brake based on said characteristic parameters of the development of said surface profile in order to determine predefined recirculation flows of the liquid metal.

* * * * *